US006500218B1

(12) United States Patent
Fan

(10) Patent No.: US 6,500,218 B1
(45) Date of Patent: Dec. 31, 2002

(54) TRANSPARENT STIFF GEL CANDLE

(76) Inventor: Cheng-Jung Fan, No. 3, Lane 68, Pai-Fu Street, Lung-Tan Village, TaoYuan Hsien (TW)

( * ) Notice: Subject to any disclaimer, the term of this patent is extended or adjusted under 35 U.S.C. 154(b) by 82 days.

(21) Appl. No.: 09/660,085

(22) Filed: Sep. 12, 2000

(51) Int. Cl.[7] ..... C11C 5/00

(52) U.S. Cl. ..... 44/275; 44/265; 431/288; 431/289; 431/291

(58) Field of Search ..... 44/265, 275, 459; 431/288, 289, 291

(56) References Cited

U.S. PATENT DOCUMENTS 5,578,089 A * 11/1996 Elsamaloty ..... 44/275
5,633,286 A 5/1997 Chen
5,879,694 A * 3/1999 Morrison et al. ..... 431/288
5,884,639 A * 3/1999 Chen ..... 428/521
6,066,329 A * 5/2000 Morrison et al. ..... 44/269
6,096,102 A * 8/2000 Matthal et al. ..... 44/275
6,129,771 A * 10/2000 Ficke et al. ..... 44/275
6,171,101 B1 * 1/2001 Freeman et al. ..... 431/288

* cited by examiner

*Primary Examiner*—Margaret Medley
(74) *Attorney, Agent, or Firm*—Ostrolenk, Faber, Gerb & Soffen, LLP

(57) ABSTRACT

Novel transparent stiff gel candles comprising a hydrocarbon oil, one or more hydrogenated triblock copolymer of a thermoplastic rubber. This invention is related to candles in the form of firm gels, and more particularly to stiff heterophase, thermally reversible mineral oil gels, preferably white oil gels. The candles of the invention contain block copolymers and blends thereof, the copolymers being preferably derived from styrene-rubber block units. The candles are naturally transparent and uncolored. The gelatinous elastomer composite exhibits a novel combination of properties including unexpectedly low processing temperature, high elongation and tensile strength and excellent shape retention after extreme deformation under high velocity impact and stress conditions.

9 Claims, No Drawings

TRANSPARENT STIFF GEL CANDLE

FIELD OF THE INVENTION

This invention is related to candles in the form of firm gels, and more particularly to stiff heterophase, thermally reversible mineral oil gels, preferably white oil gels. The candles of the invention contain block copolymers and blends thereof, the copolymers being preferably derived from styrene-rubber block units. The candles are naturally transparent and uncolored. Optionally, the candles may be colored with one or more colors, and may contain embedded and/or ornamental features, as well as fragrances and functional additives.

BACKGROUND OF THE INVENTION

Candles made of conventional waxes are well known. A major decorative drawback to such a candle is that the use of waxes necessitates that the candle be opaque, thus limiting the ornamental capacity of the candles with respect to embedded decorative features.

Clear oil jar candles are also known in the art. However, prior to the present invention, these candles have been in liquid form only. These clear liquid candles while permitting a type of embedded ornamental feature, do not permit the shaping of, for example, a pillar candle. The liquid candles are known to accumulate dust and other particulate matter from the air, thereby requiring that the oil be periodically discarded for aesthetic reasons. Additionally, liquid oil candles may spill and damage furnishings and the like. As yet another drawback, the user must assemble liquid candles.

U.S. Pat. No. 5,132,355 discloses a polyethylene block copolymer gelling agent, which may be used as a base for a decorative molded candle. The candle, however, is not transparent, and thus is of limited decorative value.

U.S. Pat. No. 5,879,694 discloses a transparent gel candle comprising hydrocarbon oil, and one or more triblock, radial block or multiblock copolymer of a thermoplastic rubber. The triblock. however, is made from Kiaton 1650 copolymer comprises a styrene-ethylene-butylene-styrene structure.

The present invention overcomes the problems in the prior art by providing stiff gel candles that are transparent. Thus, the candles of the invention permit the decorative shaping advantages of conventional wax candles as well as the embedded ornamental advantages of liquid oil candles. The candle of the present invention therefore provides an improved substitute for the conventional wax pillar or jar candle and for liquid oil jar candles.

The present invention involves a new use for oil containing block copolymer gels as the hydrocarbon source of a candle. There is a need in the art for candles with improved aesthetic properties. Stiff transparent candles, into which decorative features have been added, are particularly desired. Accordingly, in this invention, advantageous combinations of block copolymers and oils are provided which produce heterophase thermally reversible mineral oil gels, and which have desirable properties for application as a clear, stiff gel candle.

SUMMARY OF THE INVENTION

It is accordingly one object of this invention to provide heterophase, thermally reversible still gel compositions that have advantageous properties when used as a candle, preferably a clear candle.

A further object of the invention is to provide stiff hydrocarbon oil gel compositions formed from certain triblock copolymers, which have advantageous properties when used as a candle. The copolymers are preferably based on thermoplastic rubbers such as styrene-rubber block copolymers.

The gel candles of this invention comprise a Kuraray's SEPTON-4033 thermoplastic rubber. The SEPTON-4033 rubber molecule is hydrogenated styrene block polymer with 2-methyl-1,3-butadiene and 1,3-butadiene. has polystyrene end blocks and an elastomeric midblock and the following properties:

Physical form: powder

Tensile strength: 39.2 Mpa

Styrene content: 30 wt %

Solution viscosity 50±20 mPa·S (10 wt %)

Specific gravity: 0.92

Elongation: 570%

Compounding temperature: 25–37° C., 160–230° C., or 135–185° C.

Hardness: 76 JIS A

Further, the gel candles of U.S. Pat. No. 5,879,694 is made from Kraton 1650 triblock copolymer. The Kraton 1650 copolymer comprises a styrene-ethylene-butylen-styrene structure, and the following properties:

Physical form: powder

Tensile strength: 500 Psi

Styrene content: 29 wt %

Solution viscosity 8000 cps (25 wt %)

Specific gravity: 0.91

Compounding temperature: 50~150° C.

Hardness: 75 Shore A hardness

It is apparent SEPTON-4033 copolymer and Kraton 1650 copolymer are different in respect of the molecular structure and property, etc. The nature and property of gel candles of this invention and of gel candles disclosed in the '694 patent are different.

Other objects and advantages of the present invention will become apparent as the description thereof proceed.

In satisfaction of the foregoing objects and advantages, there is provided by the present invention a transparent or colored candle comprising:

(A) a hydrocarbon oil, and;

(B) a hydrogenated styrene block polymer with 2-methly-1,3-butadiene and 1,3-butadiene;

(C) a wick the candle further optionally comprising a stabilizer, anti-oxidizino agent, colorant, fragrance,and/or functional additive, and the like.

DETAILED DESCRIPTION OF PREFERRED EMBODIMENTS

It has been discovered according to the present invention that by controlling the degree of physical crosslinking exhibited in block copolymers, heterophase thermally reversible mineral oil gels can be formed which have desirable properties for use as candles. In particular, it has been found that such gels provide for stiff, transparent candles.

Under the invention, the gel consistency of the candle is controlled by varying the amount, ratio and type of certain polymers, preferably polystyrene-rubber-polystyrene triblock copolymer, to provide gels which have desirable rheological properties and thus provide for a novel firm candle. Accordingly, the present invention provides a candle that is intrinsically transparent, yet may be colored through the use of one or more colorant, if desired.

Product formation is achieved from block copolymers which form three-dimentional networks or gels through physical crosslinks. Crosslinking in these block copolymers occurs due to the formation of sub-microscopic particles of a particular block, referred to as domains. Crosslinking of the insoluble domains can be obtained by factors affecting the crosslink density of the networks including length of insoluble block domains, length of soluble block domains, and the number of crosslinkable sites.

The composition of the present candles utilizes a mixture of polymers in combination with a hydrocarbon oil. Preferably the hydrocarbon oil is white oil. Other oil, including but not limited to refined, aromatic-free paraffinic and naphthenic oils, solvents, synthetic liquid hydrogenated or unhydrogenated oilgomers of, for example, polybutene, polypropylene, polydecane, and polyterpene, are also useful in the candle of the invention.

Also preferably, the candle of the present invention comprises a wick and a gel which comprises about 83–85 weight percent white oil, and about 15–17 weight percent triblick copolymer of hydrogenated styrene block polymer with 2-methyl-1,3-butadiene and 1,3-butadiene, and said candle optionally containing one or more additives selected from the group consisting of an antioxidant, stabilizer, fragrance, colorant, and flame retardant.

Commercially available thermoplastic rubber type polymers which are especially useful in forming the compositions of the present invention are sold under the trademark SEPTON and manufactured by Kuraray Co., Ltd., Tokyo, Japan, the grade of the polymer is designated as SEPTON-4033. The SEPTON rubber is a special thermoplastic rubber which exhibits rubber-like properties over a wide range of temperatures. High strength, low viscosity, high elongation and thermoplastic behavior at elevated temperatures or in solution, are characteristics of SEPTON rubber.

SEPTON-4033 are hydrogenated styrene block copolymer materials. They are available as a hydrogenated polyisoprene/butadiene (SEEPS) polymer. Each of these polymers has its own set of unique properties.

The versatility of SEPTON-4033 polymers originates from the unique molecular structure. Each molecule of SEPTON-4033 polymer consists of block segments of styrene monomer units and hydrogenated conjugated diene monomer units. The polystyrene block acts as a crosslinking point at a temperature below the glass transition temperature of polystyrene. The rubber block acts as an origin of rubber-like properties, hydrogenation thereof provides excellent heat resistance and weatherability. The triblock structure of the SEPTON-4033 rubber molecule has polystyrene end blocks and an elastomeric midblock.

Prior to processing, the polystyrene end blocks are associated in rigid domains. In the presence of heat and shear such as during processing, the polystyrene domains soften and permit flow. After cooling, the polystyrene domains reform and harden, locking the rubber network in place. This physical phenomenon provides SEPTON-4033 rubber with its high tensile strength. The rubber midlock provides SEPTON-4033 rubber its elasticity. Since SEPTON rubber is thermoplastic, it is recyclable.

A preferred composition of the invention will contain 15.9% of the polymer blend and about 84.1 percent of the suitable hydrocarbon oil, preferably the white oil. The preferred polymer is a triblock polymer, in particular SEPTON-4033 rubber.

In a particularly preferred embodiment of the invention, the composition comprises a SEPTON triblock copolymer as described herein in combination with an oil, particularly natural or synthetic oils which are known as having a smooth homogeneous consistency.

The candle is formed by blending the polymers and oil and heating the mixture to 25–37, 160–230, or 135–185 degree Celsius depending on composition of the mixture to dissolve the copolymer or copolymer blend in the oil. Mixing maybe carried out in any conventional manner, and is preferred, particularly when colorants, fragrances, etc, are added. On cooling, a stiff, clear gel forms. Preferably, a wick is added while the composition is in melted form. Alternatively, a formed gel can be heated, the wick added, and the gel allowed to reform on cooling.

EXAMPLE 1

A blend is prepared having about one part SEPTON-4033 rubber (1.96–4.76 wt %) and about 20~50 parts white oil (95.23–98.04 wt %). These gels can be prepared by is solving the block copolymers at a temperature ranging from the room temperature to 37 degree Celsius. The solution were then poured into clear glass jars or mold and allowed to cool. When the gel candles are prepared under the room temperature, the low processing temperature has the advantage of not deteriorating its various additional properties resulting from the addition of the additives (such as the fading of the colorants or the fragrance under higher processing temperature). Moreover, the low processing temperature won't make the current invention stiffer, harder or more viscous so as to affect its processibility.

EXAMPLE 2

A blend is prepared having about 15.9 weight percent SEPTON-4033 rubber and about 84.1 weight percent white oil. These gels can be prepared by dissolving the block copolymers at a temperature ranging from 160 to 230 degree Celsius. The solution were then poured into clear glass jars or mold and allowed to cool. The high processing temperature makes it a crystal clear gel candle without any bubbles inside the transparent bulk matrix. It also has the advantage of not necessitating a container due to its higher melting point of about 75° C.

EXAMPLE 3

A blend is prepared having about 7.4 weight percent SEPTON-4033 rubber and about 92.6 weight percent white oil. These gels can be prepared by dissolving the block copolymers at a temperature ranging from 135 to 185 degree Celsius. The solution were then poured into clear glass jars or mold and allowed to cool. The high processing temperature makes it a crystal clear gel candle without any bubbles inside the transparent bulk matrix. It also has the advantage of not necessitating a container and won't be deformed during shipping due to its higher melting point of about 65° C.

The invention has been described herein with reference to certain preferred embodiments. However, as obvious variants thereon will become apparent to those skilled in the art, the invention is opt to be considered as limited thereto.

What is claimed is:

1. An article of manufacture comprising a candle, said candle comprising a wick and a gel which comprises about 83–85 weight percent white oil, and about 15–17 weight percent triblock copolymer of hydrogenated styrene block polymer with 2-methyl-1,3-butadiene and 1,3-butadiene, and said candle optionally containing one or more additives selected from the group consisting of an antioxidant, stabilizer, fragrance, colorant, and flame retardant.

2. An article of manufacture according to claim 1, wherein the article is contained in a jar.

3. An article of manufacture according to claim 1, wherein the article is not contained in a jar.

4. An article of manufacture according to claim 1, wherein said candle additionally contains an antioxidant.

5. An article of manufacture according to claim 1, wherein said candle additionally contains a fragrance.

6. An article of manufacture according to claim 1, wherein said candle additionally contains a colorant.

7. An article of manufacture according to claim 1, wherein said candle is transparent and further optionally contains in said candle a decorative material selected from the group consisting of insoluble stars, flitter, sparkles, and ribbons.

8. An article of manufacture comprising a candle, said candle comprising a wick and a gel which comprises about 97.8–98.2 weight percent white oil, and about 1.8–2.2 weight percent triblock copolymer of hydrogenated styrene block polymer with 2-methyl-1,3-butadiene and 1,3-butadiene, and said candle optionally containing one or more additives selected from the group consisting of an antioxidant, stabilizer, fragrance, colorant, and flame retardant.

9. An article of manufacture comprising a candle, said candle comprising a wick and a gel which comprises about 92–93 weight percent white oil, and about 7–8 weight percent triblock copolymer of hydrogenated styrene block polymer with 2-methyl-1,3-butadiene and 1,3-butadiene, and said candle optionally containing one or more additives selected from the group consisting of an antioxidant, stabilizer, fragrance, colorant, and flame retardant.

* * * * *